US010010146B2

(12) United States Patent
Moore

(10) Patent No.: US 10,010,146 B2
(45) Date of Patent: Jul. 3, 2018

(54) BAG SYSTEMS

(71) Applicant: Michael Moore, Seattle, WA (US)

(72) Inventor: Michael Moore, Seattle, WA (US)

(73) Assignee: Seattle Sports Company, Seattle, WA (US)

( * ) Notice: Subject to any disclaimer, the term of this patent is extended or adjusted under 35 U.S.C. 154(b) by 0 days.

(21) Appl. No.: 15/629,547

(22) Filed: Jun. 21, 2017

(65) Prior Publication Data

US 2017/0360172 A1 Dec. 21, 2017

Related U.S. Application Data

(63) Continuation of application No. PCT/US2017/038290, filed on Jun. 20, 2017.

(60) Provisional application No. 62/352,185, filed on Jun. 20, 2016.

(51) Int. Cl.

| | |
|---|---|
| ***A45C 13/26*** | (2006.01) |
| ***A45F 3/04*** | (2006.01) |
| ***A45C 1/02*** | (2006.01) |
| ***A45C 3/06*** | (2006.01) |
| ***A45C 13/10*** | (2006.01) |

(52) U.S. Cl.

CPC ..... *A45C 13/26* (2013.01); *A45C 1/02* (2013.01); *A45C 3/06* (2013.01); *A45C 13/10* (2013.01); *A45F 3/047* (2013.01)

(58) Field of Classification Search

CPC . A45C 13/262; A45C 13/26; A45C 2013/226; A45F 3/047

USPC ..... 2/338; 150/107.108; 224/910

See application file for complete search history.

(56) References Cited

U.S. PATENT DOCUMENTS

| | | | | | |
|---|---|---|---|---|---|
| 1,836,955 | A * | 12/1931 | Carlson | A44C 5/24 | 2/338 |
| 1,979,978 | A * | 11/1934 | Martin | A45C 13/26 | 190/115 |
| 4,976,388 | A * | 12/1990 | Coontz | A45C 13/30 | 224/150 |
| 5,332,137 | A * | 7/1994 | Violette | G10G 5/005 | 224/257 |
| 5,609,283 | A * | 3/1997 | Harrison, Jr. | A45F 5/02 | 224/247 |
| D409,648 | S * | 5/1999 | Gettings | 224/257 | |
| 2006/0065683 | A1* | 3/2006 | Armstrong | A45F 3/14 | 224/264 |
| 2010/0282378 | A1* | 11/2010 | Scozzafava | A45C 3/06 | 150/104 |

(Continued)

OTHER PUBLICATIONS

PCT International Search Report and Written Opinion dated Aug. 24, 2017.

*Primary Examiner* — Sue A Weaver

(74) *Attorney, Agent, or Firm* — Mitchell A. Rossman; Terra Nova Patent Law, PLLC

(57) ABSTRACT

The present invention provides a bag system with adjustable flexible straps. The bag system with adjustable flexible straps includes: a bag and one or more adjustable stretch strap systems. The bag may be a backpack, a handbag, a purse, a duffle bag, or a piece of luggage. The present invention also provides an adjustable stretch strap system. The adjustable stretch strap system includes: a flexible elongated member, one or more first members, and two or more second members; and one or more hooks for coupling to the flexible elongated member.

14 Claims, 13 Drawing Sheets

(56) References Cited

U.S. PATENT DOCUMENTS

| | | | | |
|---|---|---|---|---|
| 2013/0126566 | A1* | 5/2013 | Seuk | A45F 5/00 224/223 |
| 2014/0076950 | A1* | 3/2014 | Quintanilla | A45F 5/02 224/576 |
| 2014/0261933 | A1* | 9/2014 | Jones | A45C 3/06 150/104 |
| 2017/0265631 | A1* | 9/2017 | Kao | A45F 3/047 |

* cited by examiner

BAG SYSTEMS

RELATED APPLICATIONS

This application is a continuation application of International Application No. PCT/US17/38290, filed on Jun. 20, 2017, which claims priority to U.S. Provisional Patent Application Ser. No. 62/352,185 filed Jun. 20, 2016, which are hereby incorporated by reference in their entirety for all purposes.

BACKGROUND OF THE INVENTION

Backpacks, duffle bags, brief case bags, purses, and the like typically have non-elastic straps and/or handles that are either of fixed length non-replaceable straps and employ cumbersome devices to shorten or lengthen the straps for each user. After the straps are set to the correct length for each user, the straps do not help in providing the user a smooth and secure carry, wear out, and cannot be replaced to change the look of the bag by replacing these handles and straps.

What is needed is a bag system that allows for the user to replace the bag handles or straps easily with a color of their choice, and a strap system that provides comfort in toting through its shock-absorbing construction.

SUMMARY OF THE INVENTION

The present invention provides a bag system with adjustable flexible straps. The bag system with adjustable flexible straps includes: a bag and one or more adjustable stretch strap systems. The bag may be a backpack, a handbag, a purse, a duffle bag, or a piece of luggage.

This bag system with adjustable flexible strap allows for the bag to fit snuggly on the user and to absorb the shock of the bag moving up and down. This bag system with adjustable and detachable straps allows for the bag straps to be replaced easily to allow the user to customize the bag for their preferred color of straps. The straps of this system also allow the customer to more easily adjust the length of the strap by clipping the fixed clasp attached to the bag to a different level band. The straps themselves also provide more comfort and shock absorption as they are made from a stretchy silicone. Finally, the straps allow for items to be clipped to them to decorate or augment the bag with various tools, such as sunglass cases, cup holders, charms and lights: to allow a user to further customize their bag easily.

The present invention also provides an adjustable stretch strap system. The adjustable stretch strap system includes: a flexible elongated member, one or more first members, and two or more second members; and one or more hooks for coupling to the flexible elongated member. The adjustable stretch strap system is customizable utility bungee. The adjustable stretch strap system has an endless amount of uses: tote camp gear, bundle items in your garage, tie packs down onto a raft or in a canoe, secure your standup paddle board to a cart, hang items from the hooks, and the like.

The present invention provides a bag system. The bag system includes: a compartment having a set of walls that define a storage space, a top end, a bottom end, and two or more sides, wherein the top end includes an opening that provides access to the storage space, wherein the storage space includes a width between the two or more sides, wherein the storage space includes a depth between the top end and the bottom end; wherein the compartment includes two or more straps each independently coupled to two or more sides; one or more adjustable stretch strap systems each independently including: a flexible elongated member having a proximal end, a distal end, one or more first members, and two or more second members; a first hook having a proximal end, a distal end, wherein the first hook includes a first strap attachment at the proximal end for coupling with one of the two or more straps, wherein the distal end of the first hook is configured for coupling to one of the two or more second members of the flexible elongated member, a second hook having a proximal end, a distal end, wherein the second hook includes a second strap attachment at the proximal end for coupling with one of the two or more straps, and wherein the distal end of the second hook is configured for coupling one of the two or more second members of the flexible elongated member.

In one embodiment, the one or more first members are parallel to each other and perpendicular to the two or more second members. In one embodiment, the one or more first members comprise a first member that is perpendicular to the two or more second members. In one embodiment, the distal end of the first hook is configured for coupling to one of the two or more second members at the proximal end of the flexible elongated member. In one embodiment, the distal end of the second hook is configured for coupling one of the two or more second members at the distal end of the flexible elongated member. In one embodiment, the bag system is a backpack, a handbag, a purse, a duffle bag, or a piece of luggage.

The present invention provides a bag system. The bag system includes: a compartment having a set of walls that define a storage space, a top end, a bottom end, and two or more sides, wherein the top end includes an opening that provides access to the storage space, wherein the storage space includes a width between the two or more sides, wherein the storage space includes a depth between the top end and the bottom end; wherein the compartment includes two or more straps each independently coupled to two or more sides; one or more adjustable stretch strap systems each independently including: a flexible elongated member having a proximal end, a distal end, two first members, and two or more second members; a first hook having a proximal end, a distal end, wherein the first hook includes a first strap attachment at the proximal end for coupling with one of the two or more straps, wherein the distal end of the first hook is configured for coupling to one of the two or more second members of the flexible elongated member, a second hook having a proximal end, a distal end, wherein the second hook includes a second strap attachment at the proximal end for coupling with one of the two or more straps, and wherein the distal end of the second hook is configured for coupling one of the two or more second members of the flexible elongated member.

In one embodiment, the two first members are parallel to each other and perpendicular to the two or more second members. In one embodiment, the distal end of the first hook is configured for coupling to one of the two or more second members at the proximal end of the flexible elongated member. In one embodiment, the distal end of the second hook is configured for coupling one of the two or more second members at the distal end of the flexible elongated member. In one embodiment, the bag system is a backpack, a handbag, a purse, a duffle bag, or a piece of luggage.

The present invention provides a bag system. The bag system includes: a compartment having a set of walls that define a storage space, a top end, a bottom end, and two or more sides, wherein the top end includes an opening that provides access to the storage space, wherein the storage space includes a width between the two or more sides, wherein the storage space includes a depth between the top end and the bottom end; wherein the compartment includes two or more straps each independently coupled to two or more sides; one or more adjustable stretch strap systems each independently including: a flexible elongated member having a proximal end, a distal end, one first members, and two or more second members; a first hook having a proximal end, a distal end, wherein the first hook includes a first strap attachment at the proximal end for coupling with one of the two or more straps, wherein the distal end of the first hook is configured for coupling to one of the two or more second members of the flexible elongated member, a second hook having a proximal end, a distal end, wherein the second hook includes a second strap attachment at the proximal end for coupling with one of the two or more straps, and wherein the distal end of the second hook is configured for coupling one of the two or more second members of the flexible elongated member.

In one embodiment, the first member is perpendicular to the two or more second members. In one embodiment, the distal end of the first hook is configured for coupling to one of the two or more second members at the proximal end of the flexible elongated member. In one embodiment, the distal end of the second hook is configured for coupling one of the two or more second members at the distal end of the flexible elongated member. In one embodiment, the bag system is a backpack, a handbag, a purse, a duffle bag, or a piece of luggage.

The present invention provides a backpack system. The backpack system includes: a compartment having a set of walls that define a storage space, a top end, a bottom end, a first side, a second side, and a front and a back side, wherein the top end includes an opening that provides access to the storage space, wherein the storage space includes a width between the first side and the second side, wherein the storage space includes a depth between the top end and the bottom end; wherein the top end includes one or more top straps each independently coupled to the back side, wherein the bottom end includes one or more bottom straps each independently coupled to the back side; one or more adjustable flexible shoulder straps each independently including: a flexible elongated member having a proximal end, a distal end, two first members, and two or more second members; a top hook having a proximal end, a distal end, wherein the top hook includes a first strap attachment at the proximal end for coupling with one of the one or more top straps, wherein the distal end of the top hook is configured for coupling to one of the two or more second members of the flexible elongated member, a bottom hook having a proximal end, a distal end, wherein the bottom hook includes a second strap attachment at the proximal end for coupling with one of the one or more bottom straps, and wherein the distal end of the bottom hook is configured for coupling one of the two or more second members of the flexible elongated member.

In one embodiment, the distal end of the top hook is configured for coupling to one of the two or more second members at the proximal end of the flexible elongated member. In one embodiment, the distal end of the bottom hook is configured for coupling one of the two or more second members at the distal end of the flexible elongated member.

The present invention provides an adjustable stretch strap system. The adjustable stretch strap system includes: a flexible elongated member having a proximal end, a distal end, one or more first members, and two or more second members; and one or more hooks each having a proximal end, a distal end, and an attachment member at the proximal end for coupling to the flexible elongated member.

In one embodiment, the one or more first members include two first members parallel to each other. In one embodiment, the two first members are parallel to each other and perpendicular to the two or more second members. In one embodiment, the two first members are parallel to each other and not perpendicular to the two or more second members. In one embodiment, the two first members are not parallel to each other. In one embodiment, the two first members are not parallel to each other and not perpendicular to the two or more second members.

In one embodiment, the flexible elongated member is configured to accept the attachment member with one of the first two members, with both of the first two members, with one or more of the second members, or with a combination thereof. In one embodiment, the flexible elongated member is configured to accept the distal end of each of the one or more hooks with one or more of the second members.

In one embodiment, the distal ends of the one or more hooks are each independently configured to accept a strap from a bag. In one embodiment, the bag is a backpack, a handbag, a purse, a duffle bag, or a piece of luggage.

In one embodiment, the two or more second members are each independently equally spaced between the proximal end and the distal end of the flexible elongated member. In one embodiment, the two or more second members are each independently unequally spaced between the proximal end and the distal end of the flexible elongated member.

In one embodiment, the one or more hooks each independently include a s-shaped hook, a j-shaped hook, or a combination thereof. In one embodiment, the one or more hooks each independently include one or more plastic materials, one or more metal materials, one or more wooden materials, one or more composite materials, or a combination thereof.

In one embodiment, the one or more first members include a first member. In one embodiment, the flexible elongated member is configured to accept the attachment member with the first member, with one or more of the second members, or with a combination thereof. In one embodiment, the distal ends of the one or more hooks are each independently configured to accept a strap from a bag. In one embodiment, the bag is a backpack, a handbag, a purse, a duffle bag, or a piece of luggage.

The present invention provides an adjustable stretch strap system. The adjustable stretch strap system includes: a flexible elongated member having a proximal end, a distal end, two first members, and two or more second members, wherein the two first members are parallel to each other and perpendicular to the two or more second members, wherein the two or more second members are each independently equally spaced between the proximal end and the distal end of the flexible elongated member; and one or more hooks each having a proximal end, a distal end, and an attachment member at the proximal end for coupling to the flexible elongated member.

In one embodiment, the flexible elongated member is configured to accept the attachment member with one of the first two members, with both of the first two members, with one or more of the second members, or with a combination thereof. In one embodiment, the one or more hooks each independently include a s-shaped hook, a j-shaped hook, or a combination thereof.

The present invention provides an adjustable stretch strap system. The adjustable stretch strap system includes: a flexible elongated member having a proximal end, a distal end, a first member, and two or more second members; and one or more hooks each having a proximal end, a distal end, and an attachment member at the proximal end for coupling to the flexible elongated member.

In one embodiment, the flexible elongated member is configured to accept the attachment member with the first member, with one or more of the second members, or with a combination thereof. In one embodiment, the distal ends of the one or more hooks are each independently configured to accept a strap from a bag. In one embodiment, the bag is a backpack, a handbag, a purse, a duffle bag, or a piece of luggage. In one embodiment, the one or more hooks each independently include a s-shaped hook, a j-shaped hook, or a combination thereof.

The present invention provides an adjustable stretch strap system for a bag. The adjustable stretch strap system for a bag includes: a flexible elongated member having a proximal end, a distal end, one or more first members, and two or more second members; and two hooks each having a first attachment member at the proximal end and a second attachment member at the distal end for coupling the flexible elongated member to the bag. In one embodiment, the two first members are parallel to each other and perpendicular to the two or more second members. In one embodiment, the one or more first members include a first member. In one embodiment, the bag is a backpack, a handbag, a purse, a duffle bag, or a piece of luggage. In one embodiment, the one or more hooks each independently include a s-shaped hook, a j-shaped hook, a strap-hook, or a combination thereof.

The present invention provides an adjustable stretch strap system for a bag. The adjustable stretch strap system for a bag includes: a flexible elongated member having a proximal end, a distal end, two first members, and two or more second members, wherein the two first members are parallel to each other and perpendicular to the two or more second members, wherein the two or more second members are each independently equally spaced between the proximal end and the distal end of the flexible elongated member; two hooks each having a first attachment member at the proximal end and a second attachment member at the distal end for coupling the flexible elongated member to the bag, and wherein the distal ends of the one or more hooks are each independently configured to accept a strap from a bag. In one embodiment, the bag is a backpack, a handbag, a purse, a duffle bag, or a piece of luggage.

In one embodiment, the flexible elongated member is configured to accept the attachment member with one of the first two members, with both of the first two members, with one or more of the second members, or with a combination thereof. In one embodiment, the one or more hooks each independently include a s-shaped hook, a j-shaped hook, a strap-hook, or a combination thereof.

BRIEF DESCRIPTION OF THE DRAWINGS

Embodiments of the invention may be best understood by referring to the following description and accompanying drawings, which illustrate such embodiments. In the drawings.

Figure 1:
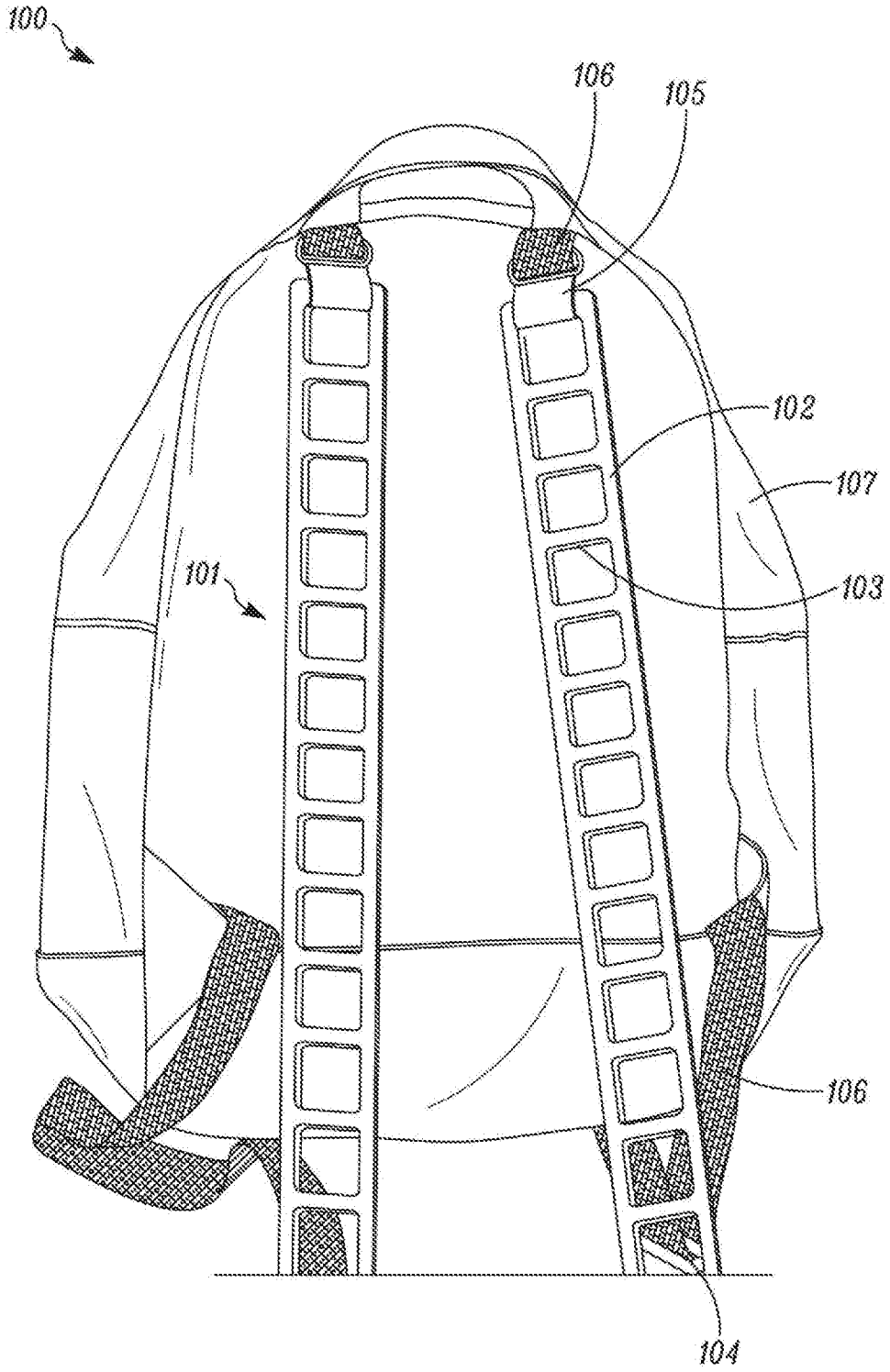
FIGS. 1-3 are perspective drawings illustrating an exemplary bag system with adjustable flexible straps.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides an adjustable stretch strap system. The adjustable stretch strap system includes: a flexible elongated member, one or more first members, and two or more second members; and one or more hooks for coupling to the flexible elongated member. The adjustable stretch strap system is customizable utility bungee. The adjustable stretch strap system has an endless amount of uses: tote camp gear, bundle items in your garage, tie packs down onto a raft or in a canoe, secure your standup paddle board to a cart, hang items from the hooks, and the like.

The present invention provides a bag system with adjustable flexible straps. The bag system with adjustable flexible straps includes: a bag and one or more adjustable stretch strap systems. The bag may be a backpack, a handbag, a purse, a duffle bag, or a piece of luggage. This bag system with adjustable flexible straps allows for the bag to fit snuggly on the user and to absorb the shock of the bag moving up and down.

The present invention also provides an adjustable stretch strap system. The adjustable stretch strap system includes: a flexible elongated member, one or more first members, and two or more second members; and one or more hooks for coupling to the flexible elongated member. The adjustable stretch strap system is customizable utility bungee. The adjustable stretch strap system has an endless amount of uses: tote camp gear, bundle items in your garage, tie packs down onto a raft or in a canoe, secure your standup paddle board to a cart, hang items from the hooks, and the like.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "comprising" or "comprises" is intended to mean that the compositions and methods include the recited elements, but not excluding others.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "proximal" refers to the closest end of an object. In contrast, the term "distal" refers to the farthest end of an object.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention illustratively disclosed herein suitably may be practiced in the absence of any element which is not specifically disclosed herein.

Figure 2:
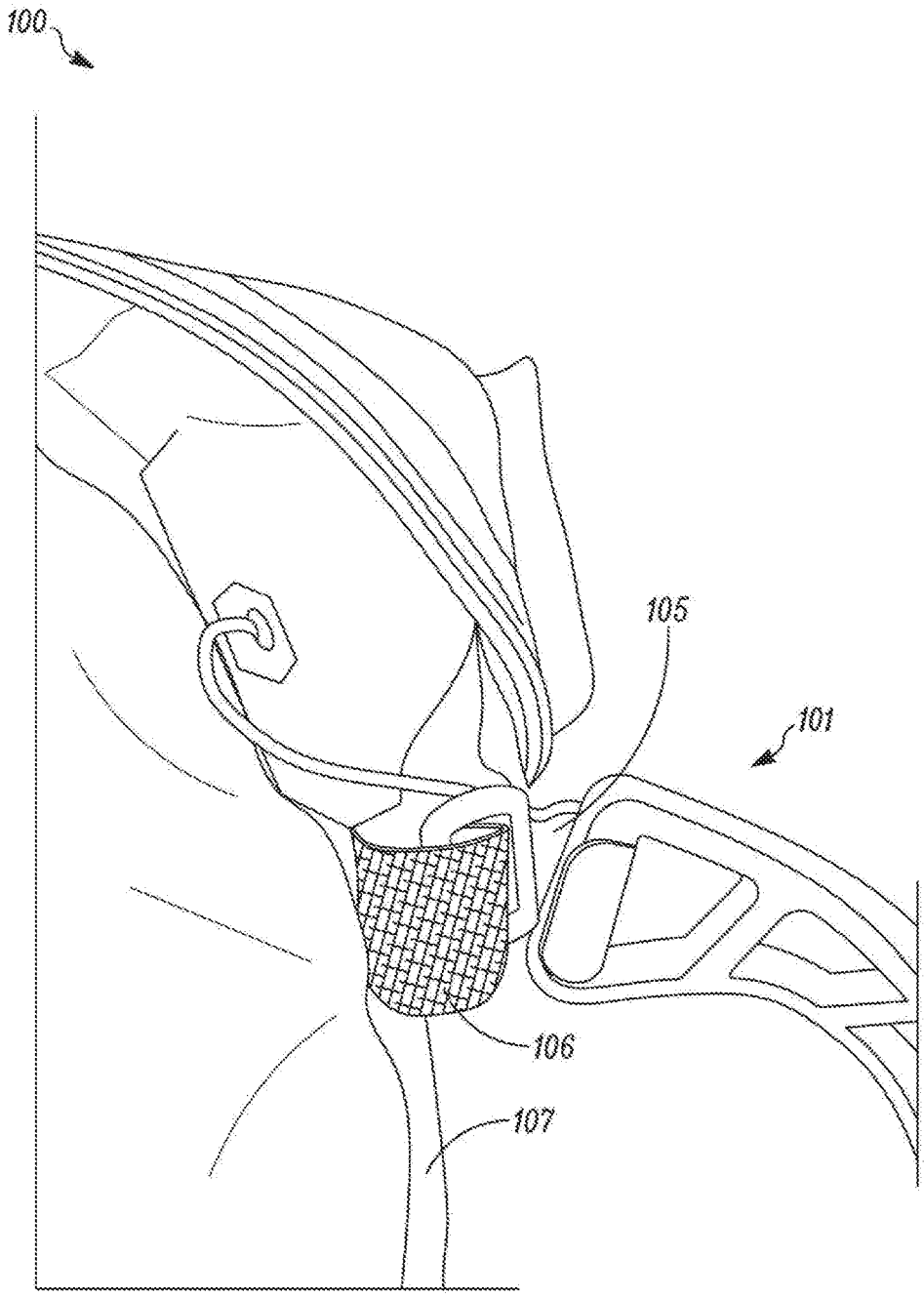
Figure 3:
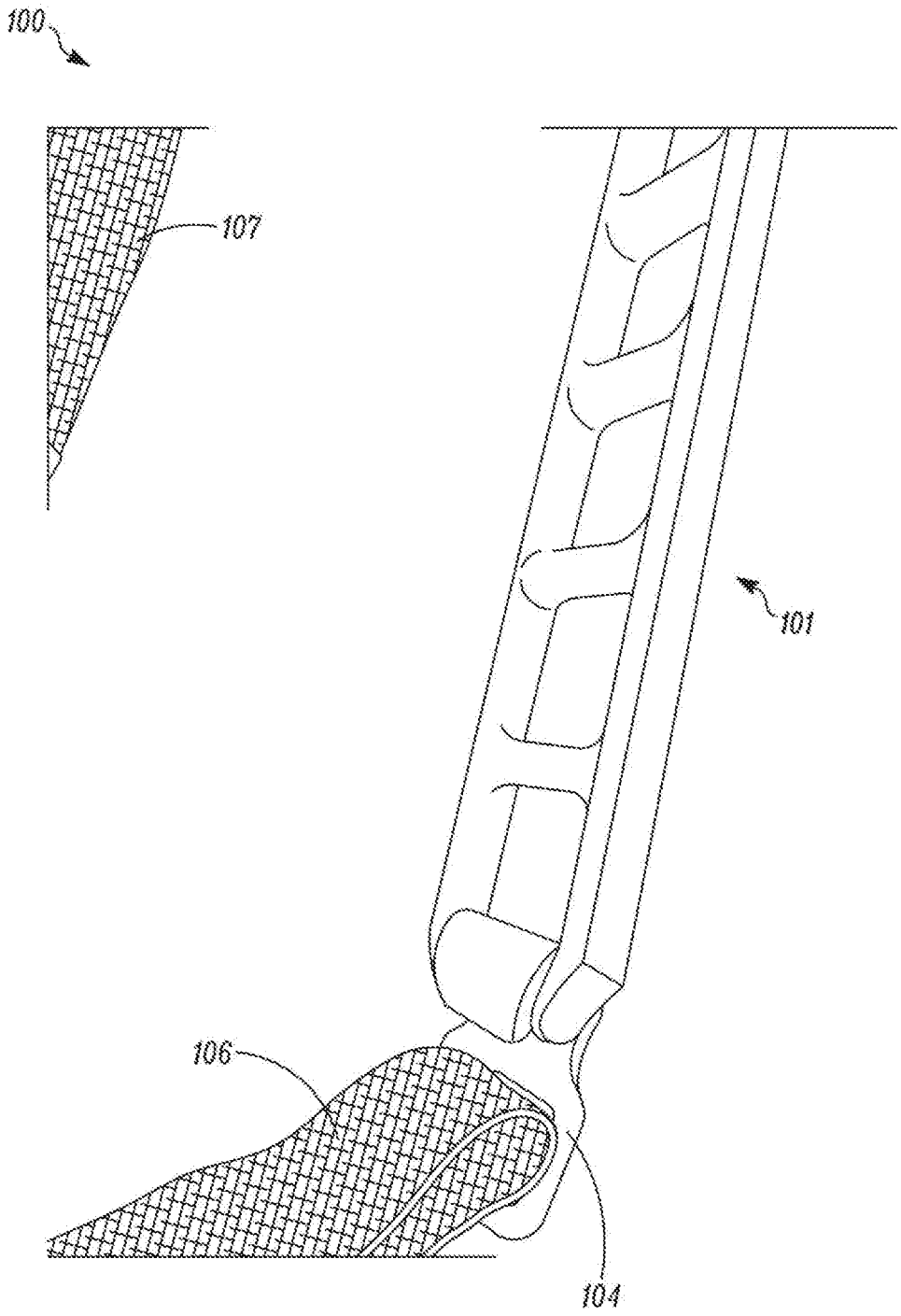

FIGS. 1-3 are perspective drawings illustrating an exemplary bag system with adjustable flexible straps with two exemplary adjustable stretch strap systems used as shoulder straps. A bag system with adjustable flexible straps 100 includes a flexible elongated member 101, two first members 102, two or more second members 103; a first hook 104, and a second hook 105. The first hook 104 is configured to accept the lower strap 106 from the backpack 107. The second hook 105 is configured to accept the strap 106 sewn into the top of the backpack 107. The user (not shown) slips on the backpack 107 and adjusts the tension of the flexible elongated members 101 by coupling the first hooks 104 to the appropriate second members 103.

The first hooks 104 and the second hooks 105 may include s-shaped hooks, j-shaped hooks, strap-hooks, and the like, or a combination thereof.

This bag system with adjustable flexible straps 100 allows for the backpack 107 to fit snuggly on the user (not shown) and to absorb the shock of the backpack 107 moving up and down. This bag system with adjustable flexible straps 100 can be easily detached and replaced with another bag system with adjustable flexible straps of a different color allowing for the user to customize their backpack 107. This bag system with adjustable flexible straps 100 also allows for additional components (not shown), for example, hooks, water bottle holders, tools, charms, and the like, to be hung off the front the flexible elongated members 101. This bag system with adjustable flexible straps 100 may also be miniaturized and used for eye glass retainers, key chains, watch bands, wallet bands, and the like.

Figure 4:
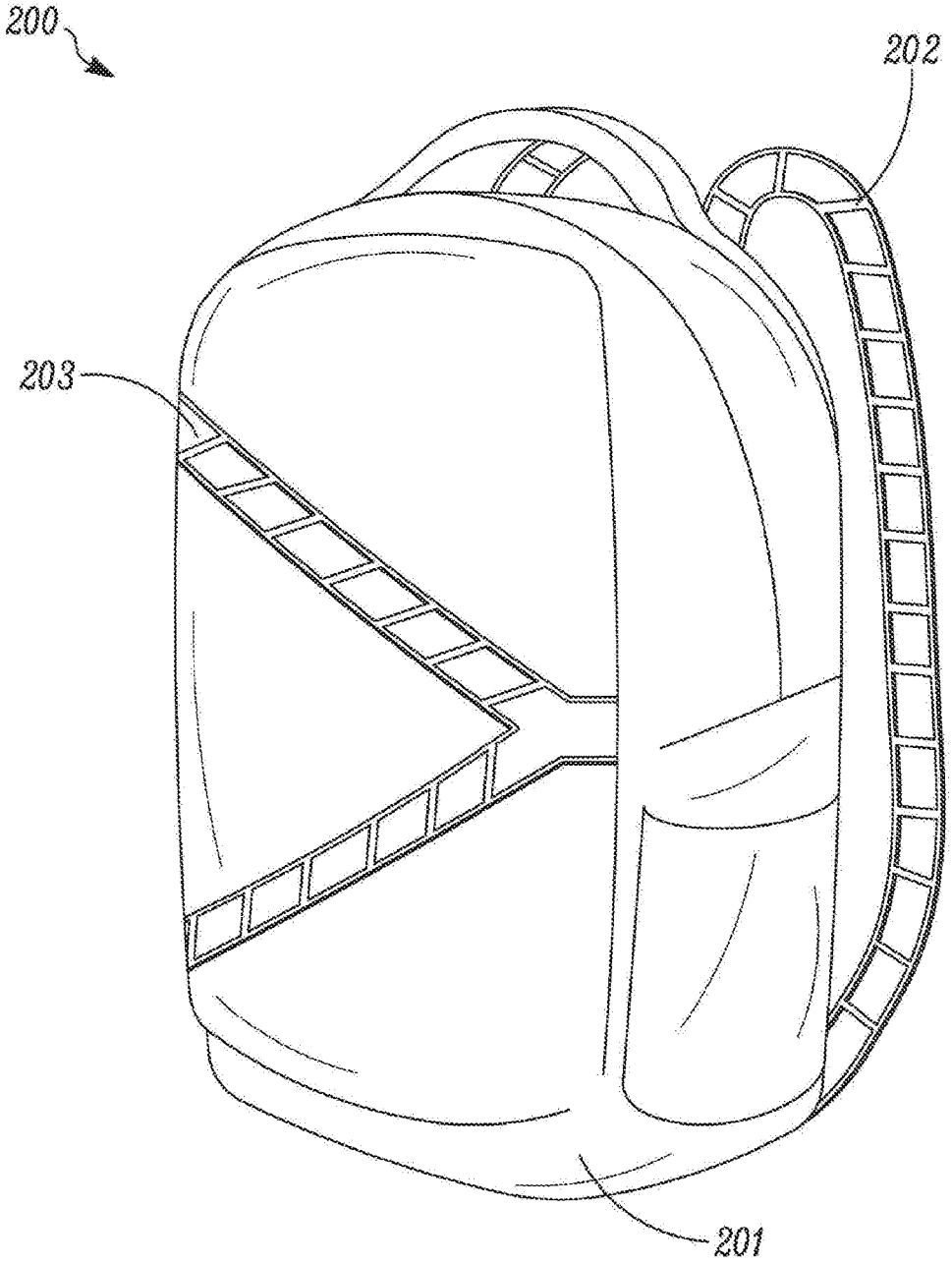
FIG. 4 is a perspective drawing illustrating an exemplary backpack system.

FIG. 4 is a perspective drawing illustrating an exemplary backpack system 200. The backpack system 200 includes a backpack 201, two adjustable stretch strap systems 202 as shoulder straps, and another adjustable stretch strap system 203 to attach various articles (not shown) to the back of the backpack 201. The adjustable stretch strap systems 202 are coupled to the backpack 201 in a manner described for the backpack system 100 above.

Figure 5:
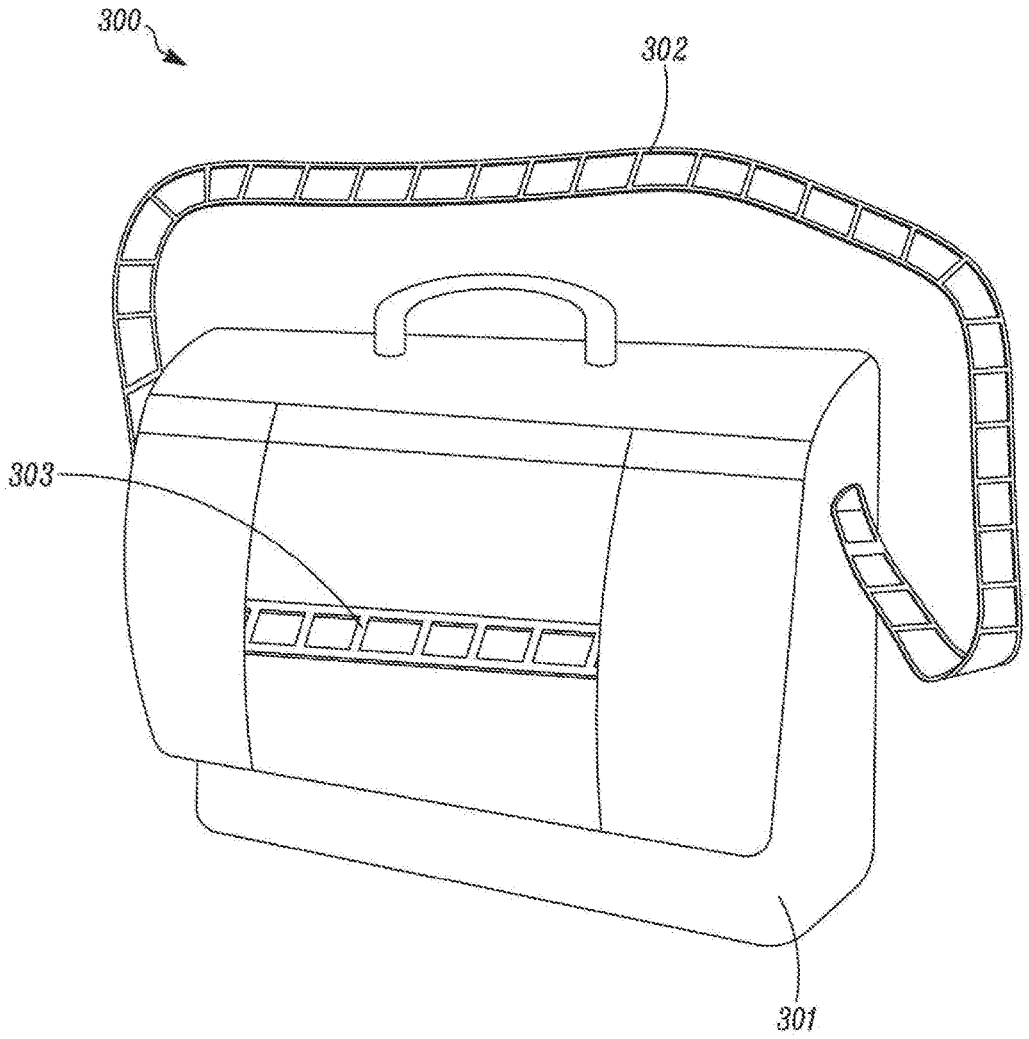
FIG. 5 is a perspective drawing illustrating an exemplary briefcase system.

FIG. 5 is a perspective drawing illustrating an exemplary briefcase system 300. The briefcase system 300 includes a briefcase 301, an adjustable stretch strap system as shoulder strap 302, and another adjustable stretch strap system 303 to attach various articles (not shown) to the front of the briefcase 301. The adjustable stretch strap system 302 is coupled to the backpack system 300 in a manner described for the backpack system 100 above.

Figure 6:
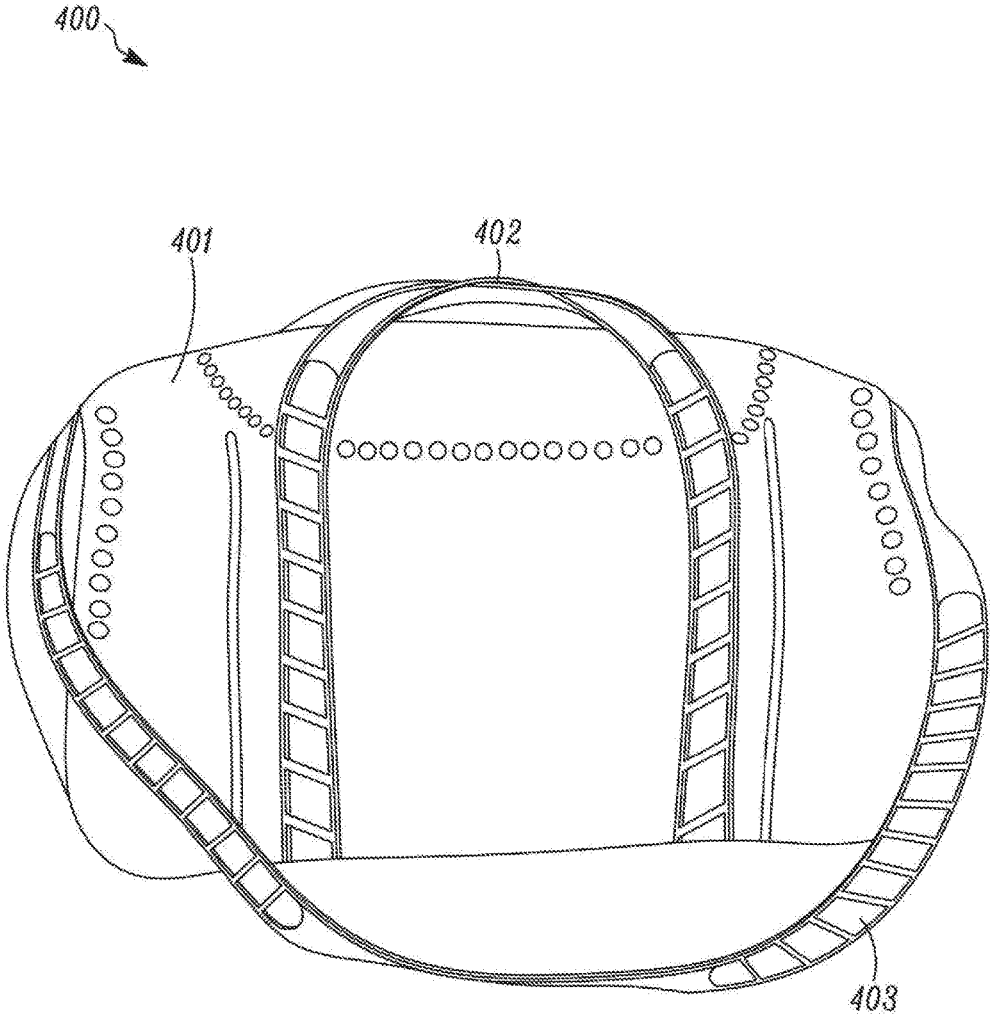
FIG. 6 is a perspective drawing illustrating an exemplary duffle bag system with adjustable flexible straps.

FIG. 6 is a perspective drawing illustrating an exemplary duffle bag system with adjustable flexible straps 400. The duffle bag system with adjustable flexible straps 400 includes a duffle bag 401, two adjustable stretch strap systems as handles 402, and another adjustable stretch strap system as shoulder strap 403. The adjustable stretch strap systems 402 are coupled to the duffle bag 401 in a manner described for the backpack system 100 above.

Figure 7:
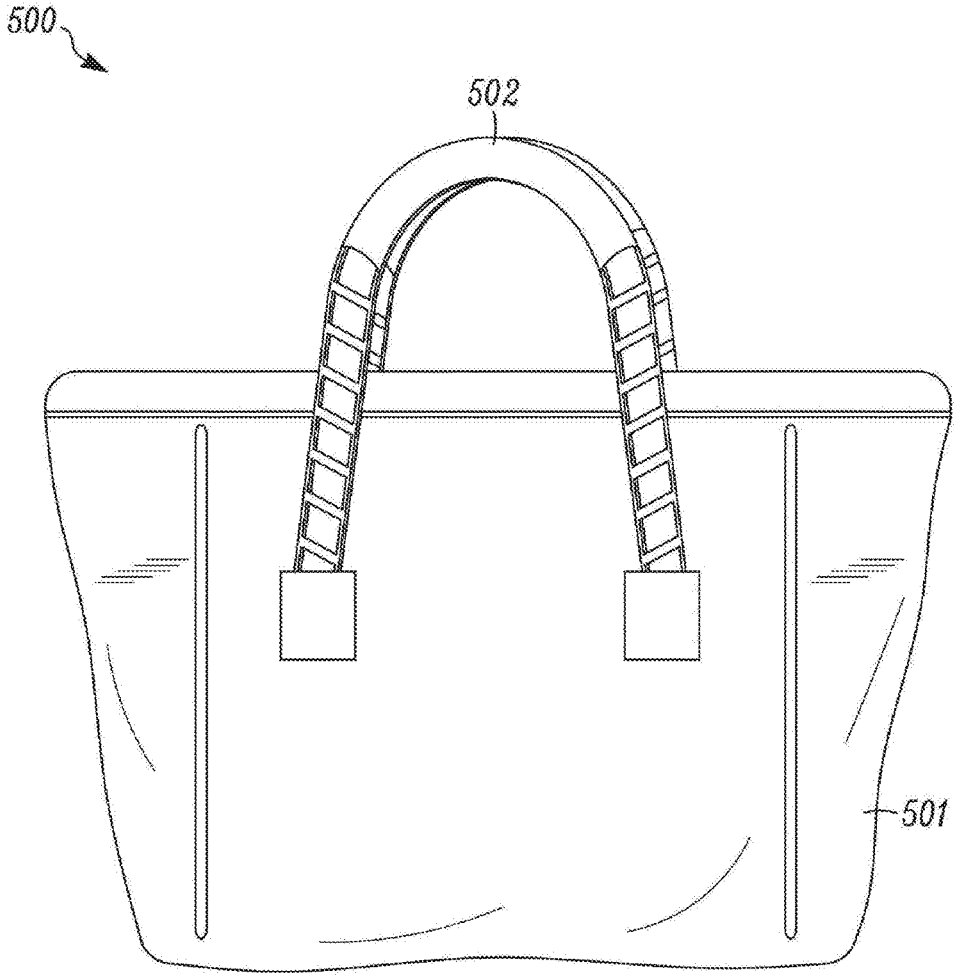
FIG. 7 is a perspective drawing illustrating an exemplary purse system.

FIG. 7 is a perspective drawing illustrating an exemplary purse system 500. The purse system 500 includes purse 501 and two adjustable stretch strap systems that are used as handles 502. The adjustable stretch strap systems 502 are coupled to the purse 501 in a manner described for the backpack system 100 above.

Figure 8:
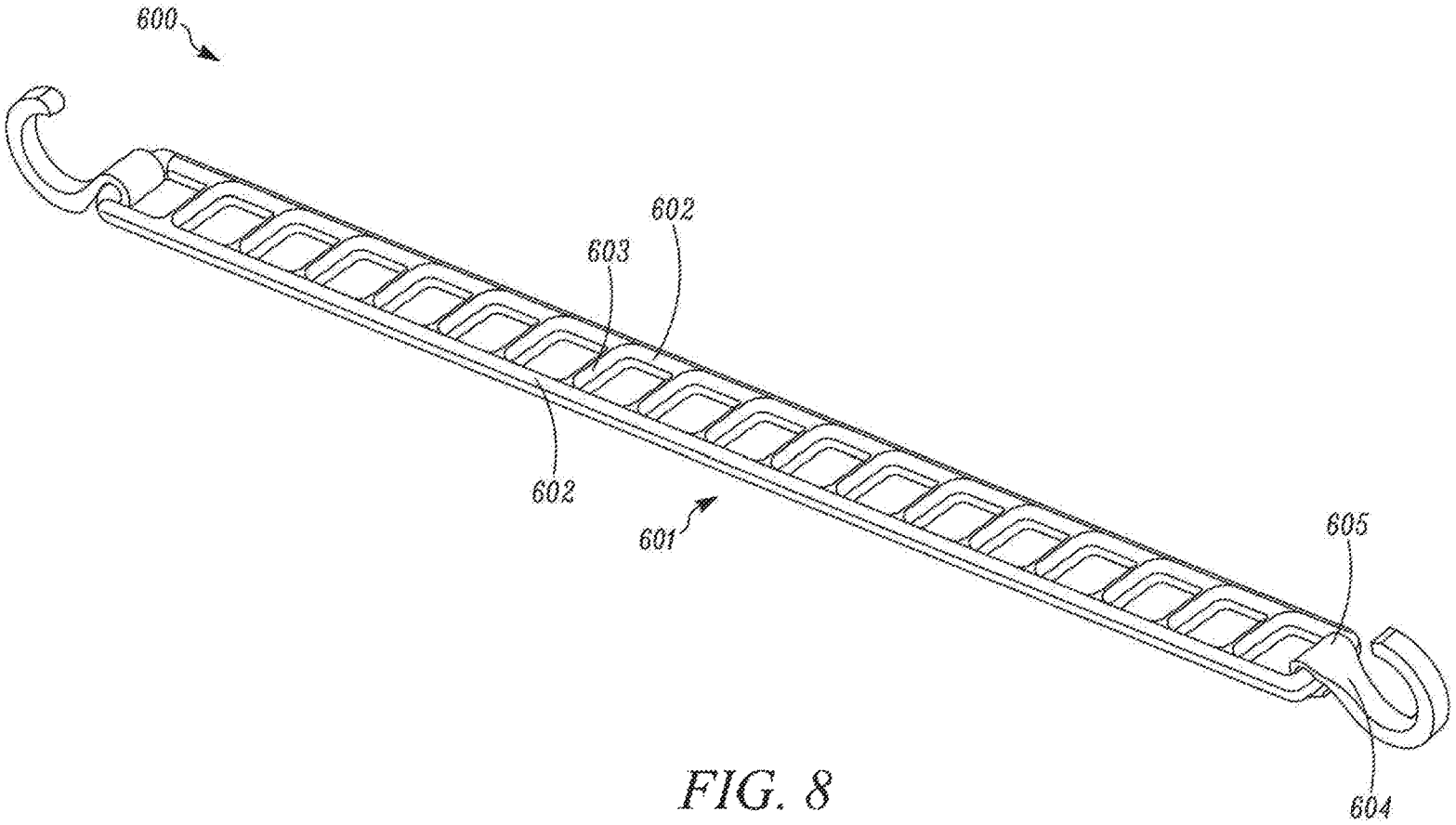
FIG. 8 is a perspective drawing illustrating an exemplary adjustable stretch strap system.

FIG. 8 is a perspective drawing illustrating an exemplary adjustable stretch strap system 600. The adjustable stretch strap system 600 includes a flexible elongated member 601 having two first members 602 and two or more second members 603; and two hooks 604. The flexible elongated member 601 includes two first members 602 that are parallel to each other and perpendicular to the two or more second members 603. The two or more second members 603 are each independently equally spaced between the proximal end and the distal end of the flexible elongated member 601. The flexible elongated member 601 is made of an elastic material, for example, silicone rubber, neoprene rubber, and the like. The two hooks 604 each have an attachment member 605 that couples to the two first members 602, the two or more second members 603, or a combination thereof. The two hooks 604 are attached at each end of the flexible elongated member 601 and each face the same direction. The two hooks 604 are j-shaped hooks.

Figure 9:
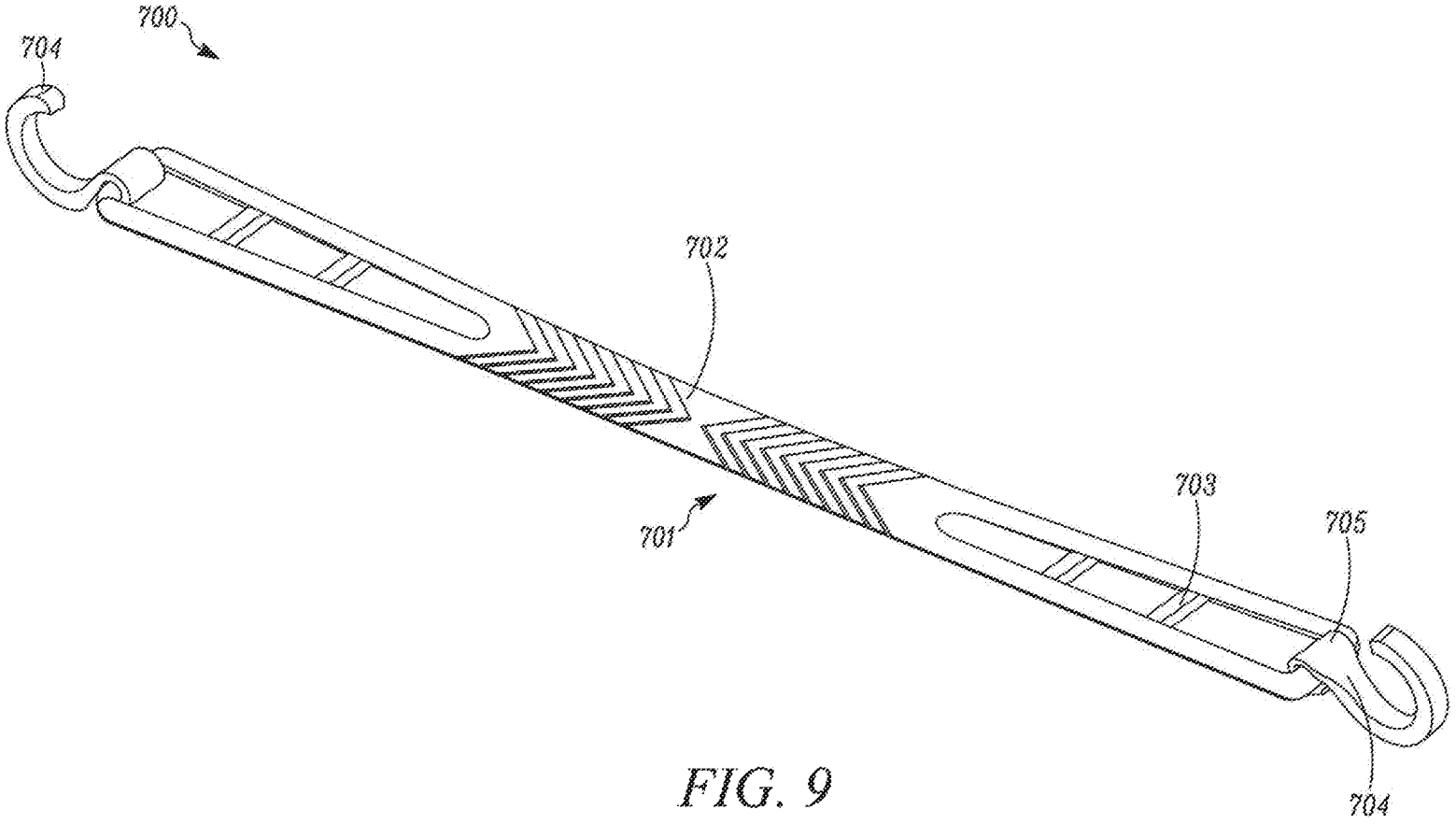
FIG. 9 is a perspective drawing illustrating an exemplary adjustable stretch strap system.

FIG. 9 is a perspective drawing illustrating an exemplary adjustable stretch strap system 700. The adjustable stretch strap system 700 includes a flexible elongated member 701 having a first member 702, two or more second members 703; and two hooks 704. The flexible elongated member 701 includes a first member 702 that is perpendicular to the two or more second members 703. The two or more second members 703 are each independently equally spaced between the proximal end and the distal end of the flexible elongated member 701, except for the solid section in the middle of the first member 702. The flexible elongated member 701 is made of an elastic material, for example, silicone rubber, neoprene rubber, and the like. The two hooks 704 each have an attachment member 705 that couples to the first member 702, the two or more second members 703, or a combination thereof. The two hooks 704 are attached at each end of the flexible elongated member 701 and each face the same direction. The two hooks 704 are j-shaped hooks.

Figure 10:
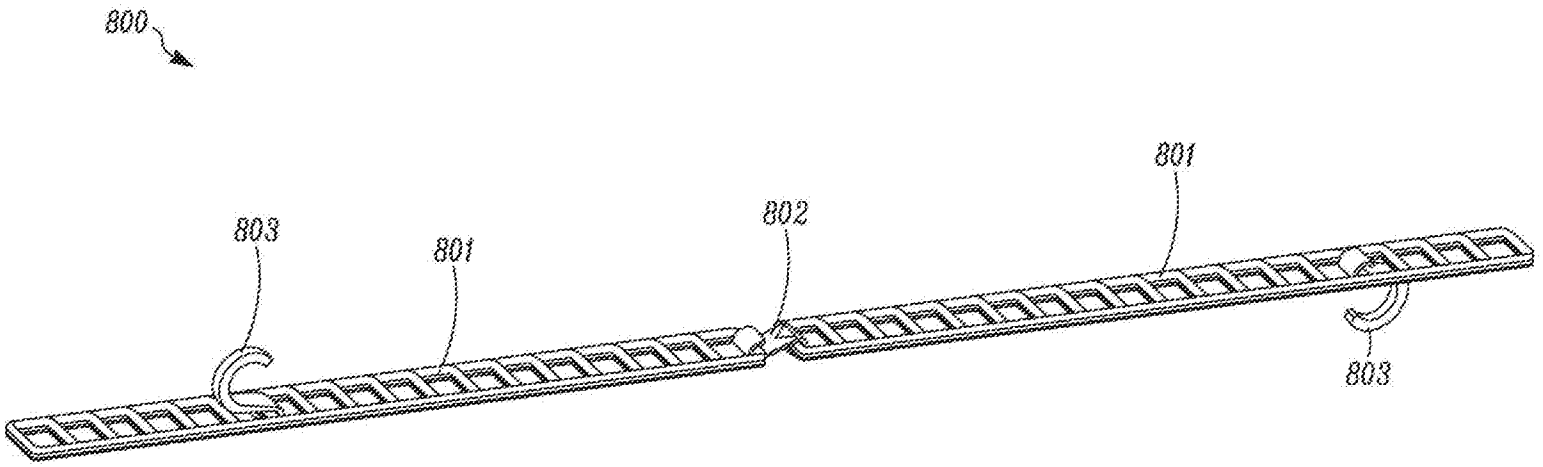
FIG. 10 is a perspective drawing illustrating an exemplary adjustable stretch strap system

FIG. 10 is a perspective drawing illustrating an exemplary adjustable stretch strap system 800. The first elastic band 801 is connected at the distal end to a s-shaped hook 802, which is connected to the proximal end of the second elastic band 801. The two elastic bands 801 have two j-shaped hooks 803 on opposite sides. In this manner, two or more exemplary adjustable stretch strap systems 800 may be connected to form a long chain, or to branch off from each other. In this manner, the exemplary adjustable stretch strap system 800 may be used in many ways to secure an object.

Figure 11:
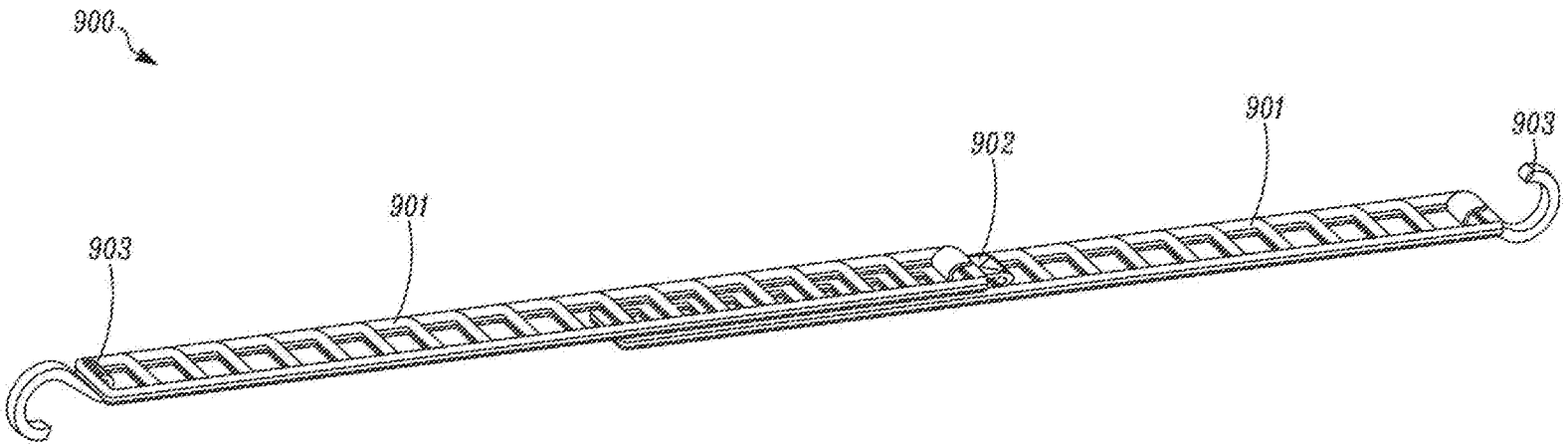
FIG. 11 is a perspective drawing illustrating an exemplary adjustable stretch strap system.

FIG. 11 is a perspective drawing illustrating an exemplary adjustable stretch strap system 900. The first elastic band 901 is connected at the distal end to a s-shaped hook 902, which is connected in between the proximal end and the distal end of the second elastic band 901. The two elastic bands 901 have two j-shaped hooks 903 on opposite sides. In this manner, two or more exemplary adjustable stretch strap systems 900 may be connected to form a long chain, or to branch off from each other. In this manner, the exemplary adjustable stretch strap system 900 may be used in many ways to secure an object.

Figure 12:
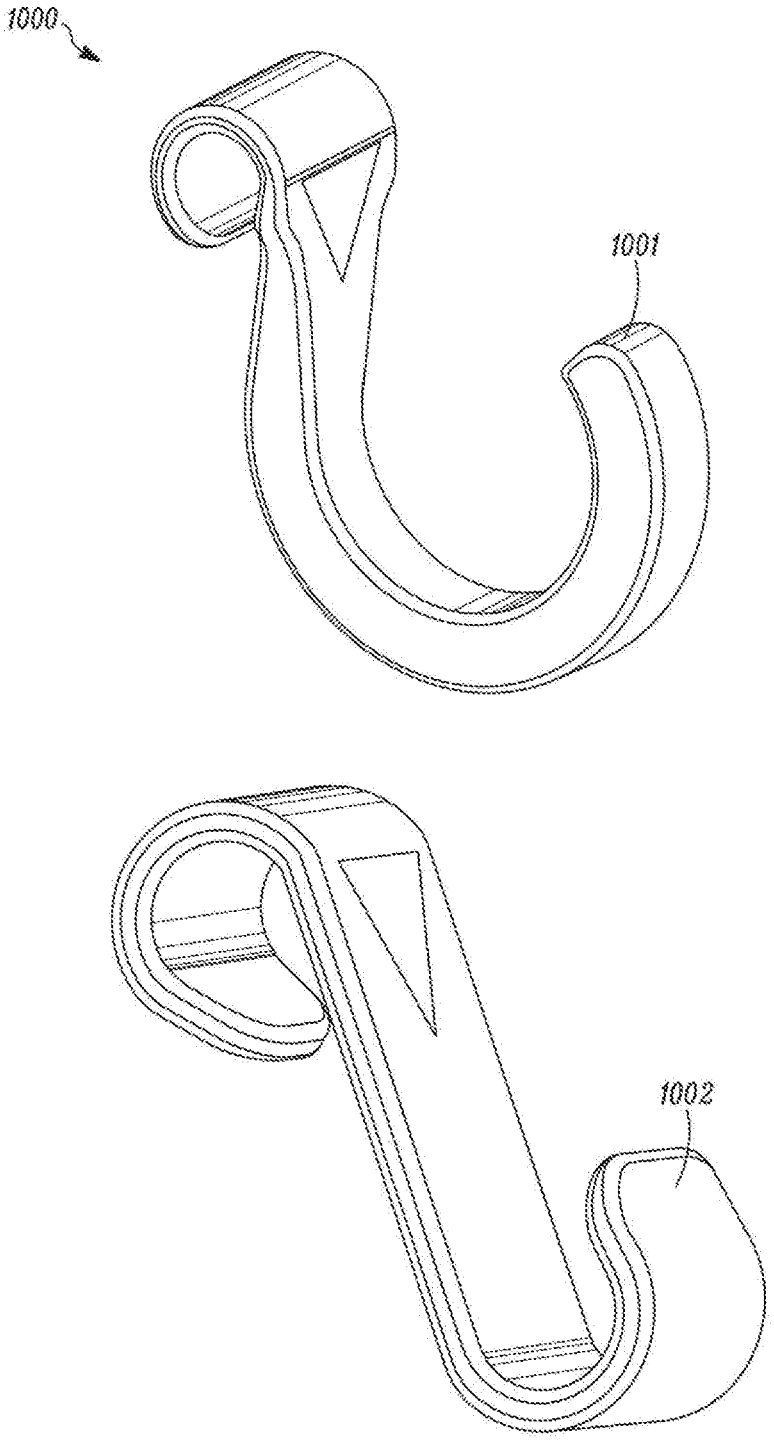
FIG. 12 are perspective drawings illustrating two exemplary hooks used in an exemplary adjustable stretch strap system.

FIG. 12 are perspective drawings illustrating two exemplary hooks used in an exemplary adjustable stretch strap system as the first hook 1000. The first hook 1001 is a j-shaped hook that is typically used to secure objects to the exemplary adjustable stretch strap system. The proximal end of first hook 1001 is configured for coupling at the proximal and distal ends of the first members on the flexible elongated members (not shown), along the length(s) of the first members on the flexible elongated members (not shown), with one of the second members (not shown), or a combination thereof. However, the first hook 1001 are not limited to this shape, but can be of any shape that serves to couple the first member(s) (not shown) and the second members (not shown) of the flexible elongated member (not shown).

The second hook 1002 is an s-shaped hook that is typically used to secure two or more exemplary adjustable stretch strap systems together. The proximal end of second hook 1002 is configured for coupling at the proximal and distal ends of the first members on the flexible elongated members (not shown), with one of the second members (not shown), or a combination thereof. However, the second hook 1002 can be of any shape that serves to couple the first member(s) (not shown) and the second members (not shown) of the flexible elongated member (not shown).

Figure 13:
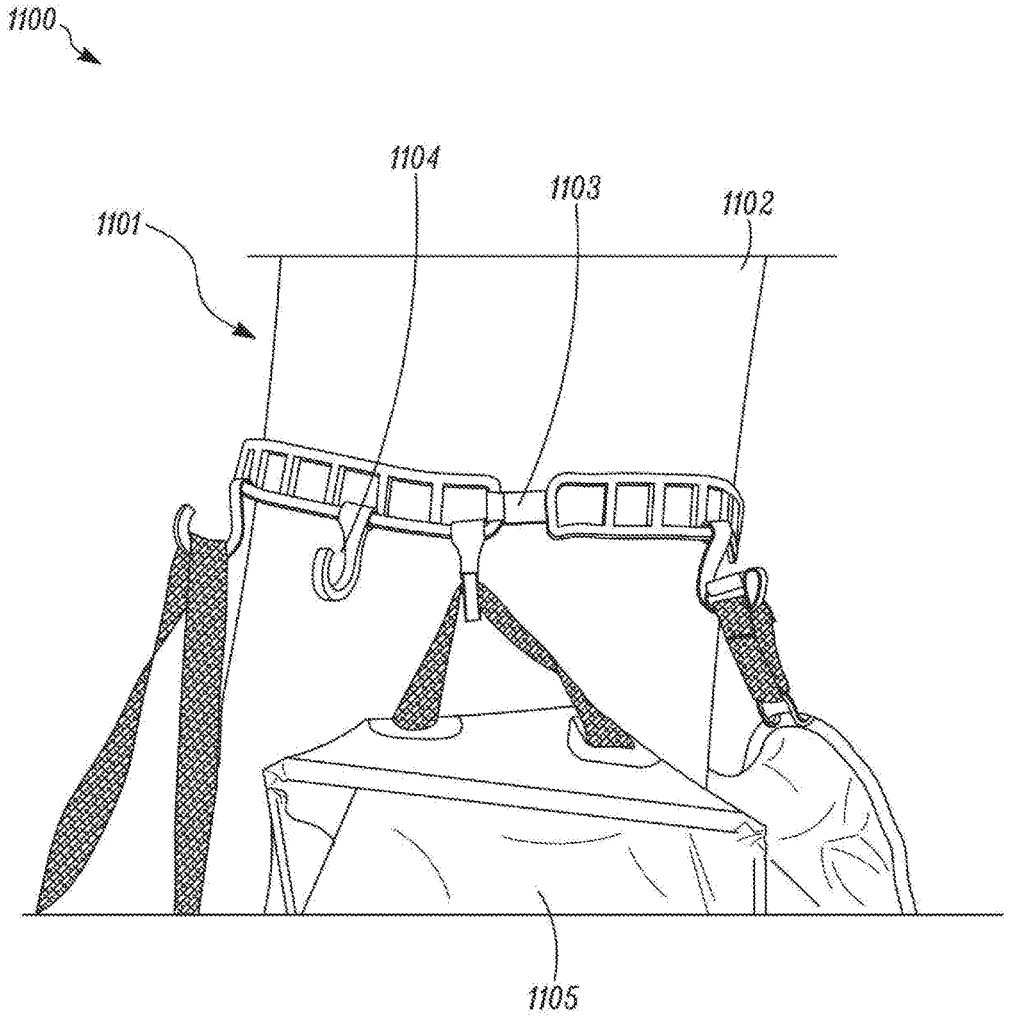
FIG. 13 is a perspective drawing illustrating an exemplary adjustable stretch strap system fixed to a tree to support several backpacks.

FIG. 13 is a perspective drawing illustrating an exemplary adjustable stretch strap system fixed to a tree to support several backpacks. In this embodiment, the adjustable stretch strap system 1100 includes a flexible elongated member 1101, secured to a tree 1102 by the s-shaped hook 1103 coupling the ends of the flexible elongated members 1101. Several j-shaped hooks 1104 are coupled to the flexible elongated member 1101 to support several backpacks 1105.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance or component fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A bag system comprising:

a compartment having a set of walls that define a storage space, a top end, a bottom end, and two or more sides,
wherein the top end comprises an opening that provides access to the storage space,
wherein the storage space comprises a width between the two or more sides,
wherein the storage space comprises a depth between the top end and the bottom end;
wherein the compartment comprises one or more straps each independently coupled to one of the two or more sides;

one or more adjustable strap systems each independently comprising:

a flexible elongated member having a proximal end, a distal end, one or more first members, and two or more second members;

a first hook having a proximal end, a distal end,
wherein the first hook comprises a first strap attachment at the proximal end for coupling with one of the one or more straps,
wherein the distal end of the first hook is configured for coupling to one of the two or more second members of the flexible elongated member, a second hook having a proximal end, a distal end,
wherein the second hook comprises a second strap attachment at the proximal end for coupling with one of the one or more straps, and
wherein the distal end of the second hook is configured for coupling one of the two or more second members of the flexible elongated member.

2. The bag system of claim 1, wherein the one or more first members are parallel to each other and perpendicular to the two or more second members.

3. The bag system of claim 1, wherein the one or more first members comprise a first member that is perpendicular to the two or more second members.

4. The bag system of claim 1, wherein the distal end of the first hook is configured for coupling to one of the two or more second members at the proximal end of the flexible elongated member.

5. The bag system of claim 1, wherein the distal end of the second hook is configured for coupling one of the two or more second members at the distal end of the flexible elongated member.

6. The bag system of claim 1, wherein the bag system comprises a backpack, a handbag, a purse, a duffle bag, or a piece of luggage.

7. A bag system comprising:

a compartment having a set of walls that define a storage space, a top end, a bottom end, and two or more sides,
wherein the top end comprises an opening that provides access to the storage space,
wherein the storage space comprises a width between the two or more sides,
wherein the storage space comprises a depth between the top end and the bottom end;
wherein the compartment comprises two or more straps each independently coupled to two or more sides;

one or more adjustable strap systems each independently comprising:

a flexible elongated member having a proximal end, a distal end, two first members, and two or more second members;

a first hook having a proximal end, a distal end,
wherein the first hook comprises a first strap attachment at the proximal end for coupling with one of the two or more straps,
wherein the distal end of the first hook is configured for coupling to one of the two or more second members of the flexible elongated member, a second hook having a proximal end, a distal end,
wherein the second hook comprises a second strap attachment at the proximal end for coupling with one of the two or more straps, and
wherein the distal end of the second hook is configured for coupling one of the two or more second members of the flexible elongated member.

8. The bag system of claim 7, wherein the two first members are parallel to each other and perpendicular to the two or more second members.

9. The bag system of claim 7, wherein the distal end of the first hook is configured for coupling to one of the two or more second members at the proximal end of the flexible elongated member.

10. The bag system of claim 7, wherein the distal end of the second hook is configured for coupling one of the two or more second members at the distal end of the flexible elongated member.

11. The bag system of claim 7, wherein the bag system comprises a backpack, a handbag, a purse, a duffle bag, or a piece of luggage.

12. A backpack comprising a compartment having a set of walls that define a storage space, a top end, a bottom end, a first side, a second side, and a front and a back side, wherein the top end comprises an opening that provides access to the storage space, wherein the storage space comprises a width between the first side and the second side, wherein the storage space comprises a depth between the top end and the bottom end;

wherein the top end comprises one or more top straps each independently coupled to the back side, wherein the bottom end comprises one or more bottom straps each independently coupled to the back side;

one or more adjustable flexible shoulder straps each independently comprising:

a flexible elongated member having a proximal end, a distal end, two first members, and two or more second members;

a top hook having a proximal end, a distal end, wherein the top hook comprises a first strap attachment at the proximal end for coupling with one of the one or more top straps, wherein the distal end of the top hook is configured for coupling to one of the two or more second members of the flexible elongated member, a bottom hook having a proximal end, a distal end, wherein the bottom hook comprises a second strap attachment at the proximal end for coupling with one of the one or more bottom straps, and wherein the distal end of the bottom hook is configured for coupling one of the two or more second members of the flexible elongated member.

13. The backpack of claim 12, wherein the distal end of the top hook is configured for coupling to one of the two or more second members at the proximal end of the flexible elongated member.

14. The backpack of claim 12, wherein the distal end of the bottom hook is configured for coupling one of the two or more second members at the distal end of the flexible elongated member.

* * * * *